US006590331B1

(12) United States Patent
Soneda et al.

(10) Patent No.: US 6,590,331 B1
(45) Date of Patent: Jul. 8, 2003

(54) CRT WITH IMPLOSION-PROOF BAND AND METHOD FOR MANUFACTURING THE SAME

(75) Inventors: Koichi Soneda, Kumagaya (JP); Masayoshi Ishikawa, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 577 days.

(21) Appl. No.: 09/588,756

(22) Filed: Jun. 7, 2000

(30) Foreign Application Priority Data

Jun. 7, 1999 (JP) ..... 11-160215

(51) Int. Cl.[7] ..... H01J 1/62

(52) U.S. Cl. ..... 313/477 R; 348/822; 313/479; 445/8

(58) Field of Search ..... 313/477 R, 479; 348/818, 821, 822; 445/8

(56) References Cited

U.S. PATENT DOCUMENTS 4,701,802 A * 10/1987 Omae et al. ..... 348/822
5,181,123 A * 1/1993 Swank ..... 348/822
5,965,974 A * 10/1999 Saito et al. ..... 313/477 R
6,259,206 B1 * 7/2001 Tsuchiya et al. ..... 313/477 R

FOREIGN PATENT DOCUMENTS

| | | |
|---|---|---|
| JP | 7-21999 | 3/1995 |
| JP | 10-21857 | 1/1998 |
| JP | 10-199452 | 7/1998 |

* cited by examiner

*Primary Examiner*—Michael H. Day
(74) *Attorney, Agent, or Firm*—Pillsbury Winthrop LLP

(57) ABSTRACT

A vacuum envelope of a cathode ray tube includes a substantially rectangular panel with a skirt portion standing on an outer peripheral edge thereof. A substantially rectangular implosion-proof band made of metal is banded on the outer surface of the skirt portion. The implosion-proof band has a pair of long sides and a pair of short sides, and a yield point of a middle portion of each of the long sides differs from that of a middle portion of each of the short sides.

10 Claims, 4 Drawing Sheets

[EXPLOSION-PROOF TEST RESULTS OF CATHODE-RAY TUBES OF PRESENT INVENTION]

| LOT No. | NUMBER OF TESTS | ACCEPTANCE | REJECTION | ACCEPTANCE RATES |
|---|---|---|---|---|
| 1 | 21 | 19 | 2 | 90.5% |
| 2 | 23 | 22 | 1 | 95.7% |
| 3 | 32 | 31 | 1 | 96.9% |
| 4 | 20 | 18 | 2 | 90.0% |
| TOTAL | 96 | 90 | 6 | 93.8% |

FIG. 4

[EXPLOSION-PROOF TEST RESULTS OF CATHODE-RAY TUBES OF COMPARATIVE EXAMPLES]

| LOT No. | NUMBER OF TESTS | ACCEPTANCE | REJECTION | ACCEPTANCE RATES |
|---|---|---|---|---|
| 1 | 16 | 14 | 2 | 87.5% |
| 2 | 21 | 19 | 2 | 90.5% |
| 3 | 22 | 17 | 5 | 77.3% |
| 4 | 27 | 25 | 2 | 92.6% |
| 5 | 23 | 21 | 2 | 91.3% |
| TOTAL | 109 | 96 | 13 | 88.1% |

FIG. 5

CRT WITH IMPLOSION-PROOF BAND AND METHOD FOR MANUFACTURING THE SAME

CROSS-REFERENCE TO RELATED APPLICATIONS

This application is based upon and claims the benefit of priority from the prior Japanese Patent Application No. 11-160215, filed Jun. 7, 1999, the entire contents of which are incorporated herein by reference.

BACKGROUND OF THE INVENTION

The present invention relates to a cathode-ray tube banded with a metal implosion-proof band using a shrink-fit method, and a method for manufacturing the cathode-ray tube.

A generally-used color cathode-ray tube includes a vacuum envelope which has a substantially rectangular glass-made panel, a funnel coupled to the panel, and a cylindrical neck connected to a small-diameter section of the funnel. The panel has on its inner surface a phosphor screen which includes a plurality of red-, green- and-blue-emitting phosphor layers and light-shielding layers. A deflection yoke is mounted on the outer surfaces of the neck and funnel so as to extend from the former to the latter. In the neck is arranged an electron gun for emitting a plurality of electron beams corresponding to the luminescent colors of the phosphor layers.

A shadow mask having a color selecting function is provided inside the panel between the electron gun and the phosphor screen. The shadow mask shapes electron beams emitted from the electron gun and projects beam spots on the phosphor layers of specified colors. A skirt portion of the panel is banded with a metal implosion-proof band in order to maintain implosion-proof characteristics of the cathode-ray tube.

In the foregoing color cathode-ray tube, the implosion-proof band is usually formed in a rectangular shape by a mild steel having a uniform width and thickness and thus a yield point is fixed all over the band. The implosion-proof band described above is generally banded against the outer surface of the skirt portion of the panel by the shrink-fit method. According to the shrink-fit method, the implosion-proof band, whose inner circumference is slightly shorter than the outer circumference of the skirt portion of the panel, is expanded by preheating, and the expanded band is fitted on the outer surface of the skirt portion and then cooled, thereby banding the skirt portion with the implosion-proof band. A high banding force by the implosion-proof band is obtained at room temperature, and the implosion-proof strength of the cathode-ray tube is secured.

The implosion-proof band is usually heated (450° C. to 600° C.) almost uniformly by a gas burner or high-frequency heating. In this case, the banding force (yield stress) of the implosion-proof band becomes substantially uniform on both long and short sides of the skirt portion.

In the case of a cathode-ray tube using a rectangular panel, when an envelope is evacuated in the manufacture stage of the cathode-ray tube, the central part of a panel is deformed concavely toward the neck. Consequently a tensile stress caused on the skirt portion varies from side to side, such as 5.0 Mpa on the long sides and 5.4 MPa on the short sides. Even though the cathode-ray tube is banded with an implosion-proof band formed of a mild steel having a uniform width and thickness, neither the long nor short side of the skirt portion is banded by the optimum banding force.

According to the implosion-proof standards (UL/CSA, etc.) employed in the field of cathode-ray tubes, the safety of a cathode-ray tube is judged from the number of glass fragments flying ahead of the cathode-ray tube when a metal ball is caused to collide with the front of a panel to implode a vacuum envelope. The number of glass fragments depends upon the design (strength) of the panel and funnel. By thickening the glass of the envelope, the envelope can be broken safely or prevented from being broken. However, in this case, there occurs another problem that the cathode-ray tube increases in weight.

As a measure against the above, a safe tube can be designed and produced by optimizing the banding force of an implosion-proof band. However, as described above, tensile stresses of the tube are different at long-side, short-side and corner portions of the skirt portion and so are the banding forces required for the respective portions.

In order to resolve the above problem, Jpn. Pat. Appln. KOKAI Publication No. 10-199452 proposes a cathode-ray tube wherein the short- and long-side portions of an implosion-proof band are caused to differ in cross-sectional area to increase the banding force of the long-side portions. Further, Jpn. Pat. Appln. KOKOKU Publication No. 7-21999 proposes a cathode-ray tube in which an implosion-proof band has a bent portion covering all the edge of the front of a panel and the bent portion is formed widely from the corner portions toward the central portion to increase the banding force of the long-side portions of the panel.

Using the foregoing implosion-proof band, the implosion-proof effect can be enhanced even though the radius of curvature of a panel is large. However, the scrap rates of materials for the band are high, which means an increase in waste. Moreover, a plurality of implosion-proof bands cannot be formed using common materials if their panels are slightly different in radius of curvature, thus causing a problem of a decrease in manufacturing efficiency.

BRIEF SUMMARY OF THE INVENTION

The present invention has been developed in consideration of the above situation and its object is to provide a cathode-ray tube in which an implosion-proof band mounted on the outer surface of a skirt portion of a rectangular panel using a shrink-fit method is improved in structure and implosion-proof characteristics.

In order to attain the above object, a cathode-ray tube according to one aspect of the present invention comprises a vacuum envelope including a rectangular panel having a skirt portion; a phosphor screen formed on an inner surface of the panel; an electron gun arranged in the vacuum envelope, for emitting an electron beam to the phosphor screen; and a substantially rectangular implosion-proof band having a pair of first side portions opposed to each other and a pair of second side portions crossing the first side portions and banded against an outer surface of the skirt portion, at least part of each of the first side portions, of the implosion-proof band having a yield point which is different from that of another part of the implosion-proof band.

According to the cathode-ray tube having the above structure, the banding force of the implosion-proof band against the skirt portion can be optimized by causing the yield points of the first and second side portions of the band to differ from each other. The implosion-proof characteristics of the band can thus be improved by absorbing a difference between tensile stresses caused in the periphery of the panel.

According to the cathode-ray tube of the present invention, the skirt portion of the panel includes a pair of first side-walls contacting the first side portions of the implosion-proof band and a pair of second side-walls contacting the second side portions thereof, and the first side-walls and the second side-walls are applied with different tensile stresses. The yield point of the at least part of each first side portion of the implosion-proof band and that of another part of the implosion-proof band differ from each other in accordance with a difference in tensile stress between the first and second side-walls of the skirt portion.

For instance, when the tensile stress of the first side-walls of the skirt portion is greater than that of the second side-walls thereof, the yield point of a middle portion of each first side portion of the implosion-proof band is set greater than that of a middle portion of: each second side portion thereof.

For this reason, the banding force of the implosion-proof band against the first and second side-walls of the rectangular panel can be optimized, and the implosion-proof characteristics can be improved by absorbing a difference between tensile stresses caused in the periphery of the panel.

A method for manufacturing a cathode-ray tube according to another aspect of the present invention, comprises the steps of preparing a vacuum envelope including a panel with a skirt portion standing on a peripheral portion of the panel; preparing an implosion-proof band formed of metal and shaped like a rectangular frame, the implosion-proof band having a pair of first side portions opposed to each other and a pair of second side portions opposed to each other; expanding the implosion-proof band by heating such that at least part of each of the first side portions and another part of the implosion-proof band are heated at different temperatures to cause yield points of the at least part and the another part to differ from each other; and mounting the implosion-proof band expanded by heating on an outer surface of the skirt portion, then cooling the implosion-proof band, and banding the outer surface of the skirt portion with the implosion-proof band.

According to the manufacturing method of the present invention, that portion of the implosion-proof band where the yield point is heightened, is heated at temperature which is higher than another part of the implosion-proof band.

When the implosion-proof band is expanded by heating as described above, the yield points of respective portions of the band can be caused to differ from each other by heating the portions at different temperatures. Thus, the banding force of the implosion-proof band against the panel can be optimized, and a cathode-ray tube, which is excellent in implosion-proof characteristics, can easily be manufactured. At the same time, the implosion-proof band need not be changed in shape or provided with a bent portion in order to control the banding force. The implosion-proof band can thus be improved in versatility to lower the costs for manufacturing the cathode-ray tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 4 is a table showing implosion-proof test results of cathode-ray tubes according to the embodiment;

FIG. 5 is a table showing implosion-proof test results of cathode-ray tubes of comparative examples.

DETAILED DESCRIPTION OF THE INVENTION

A color cathode-ray tube according to an embodiment of the present invention will now be described in detail with reference to the accompanying drawings.

Figure 1:
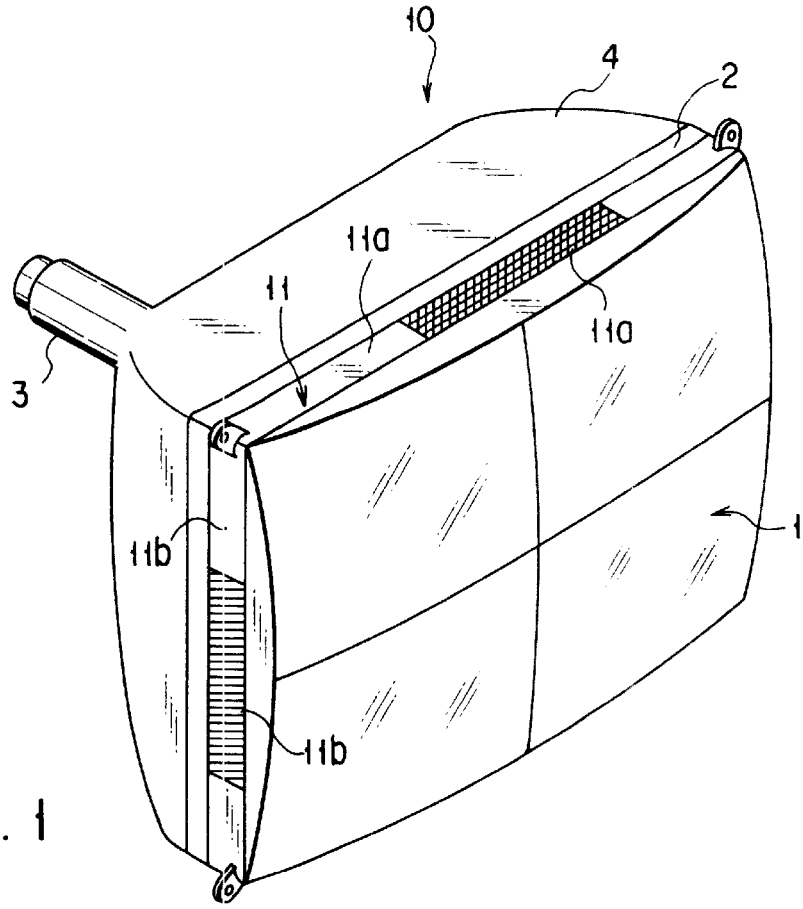
FIG. 1 is a perspective view showing a cathode-ray tube according to an embodiment of the present invention.
Figure 2:
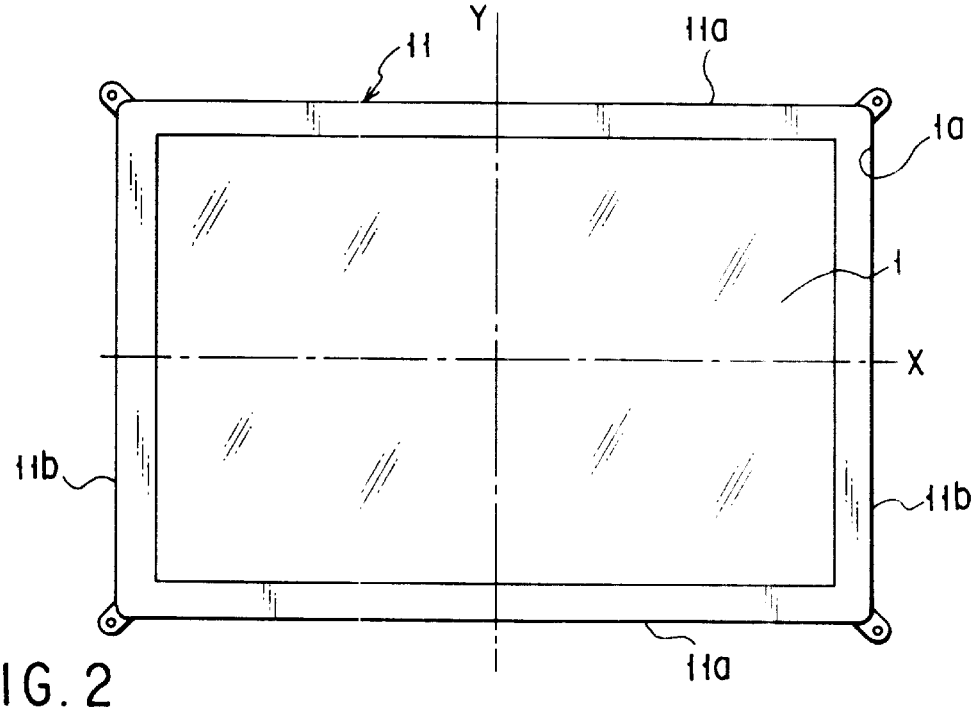
FIG. 2 is a front view of the cathode-ray tube.
Figure 3:
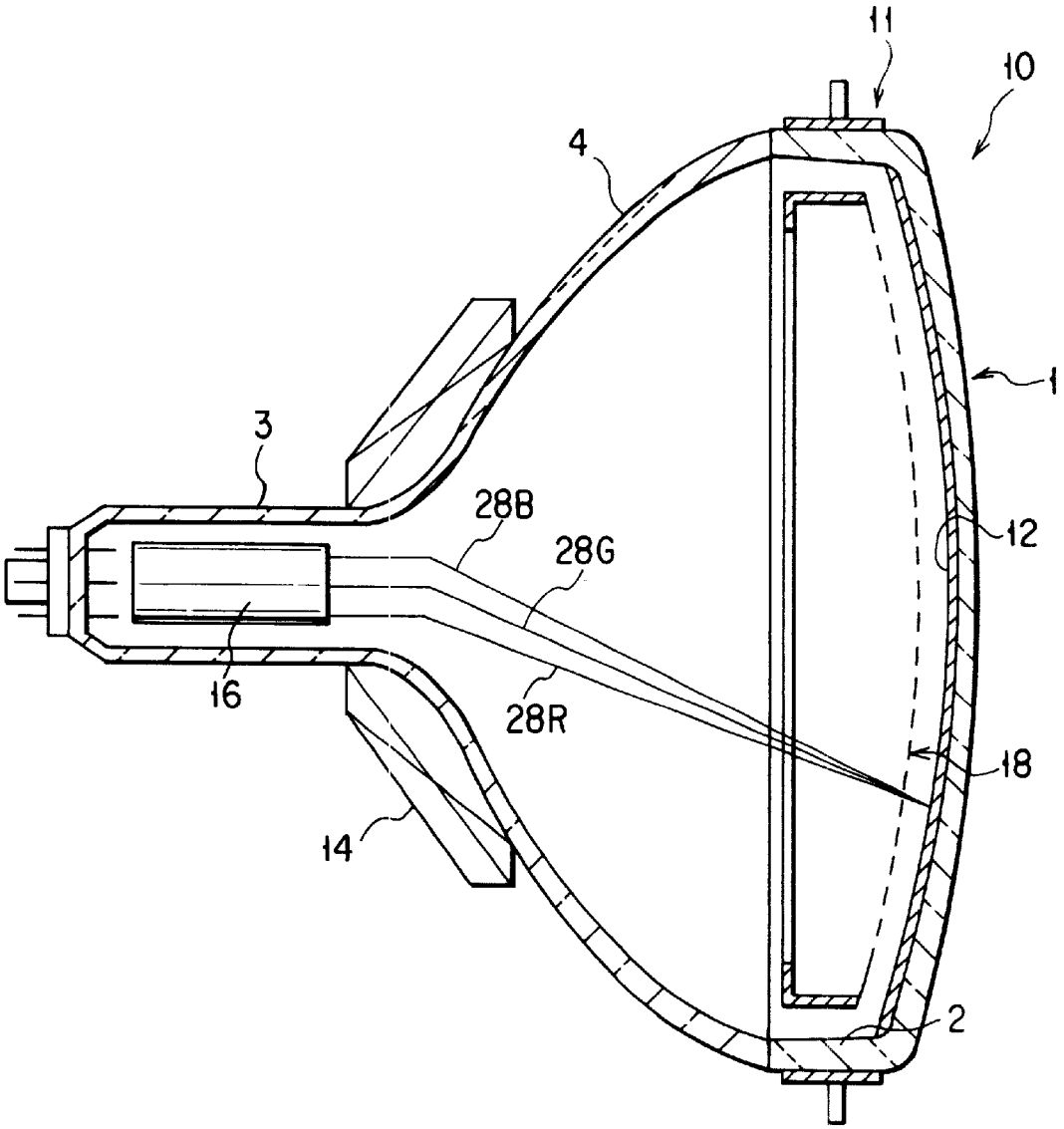
FIG. 3 is a cross-sectional view of the cathoderay tube.

Referring to FIGS. 1 to 3, the color cathode-ray tube comprises a vacuum envelope 10 which includes a substantially rectangular glass-made panel 1 having a skirt portion 2 on the outer peripheral edge thereof, a funnel 4 coupled to the skirt portion 2 of the panel 1, and a cylindrical neck 3 coupled to a small-diameter section of the funnel 4. The panel 1 measures 19 inches diagonally and has a long axis X and a short axis Y which pass through a tube axis and cross each other at right angles. The panel 1 has on its inner surface a phosphor screen 12 which is formed of a plurality of red-, green- and blue-emitting phosphor layers and light-shielding layers. A deflection yoke 14 is mounted on the outer surfaces of the neck 3 and funnel 4 so as to extend from the former to the latter. In the neck 3 is arranged an electron gun 16 for emitting three electron beams 28R, 28G and 28B toward the phosphor layers of the phosphor screen 12.

A shadow mask 18 having a color selecting function is arranged inside the panel 1 and between the electron gun 16 and the phosphor screen 12. The shadow mask 18 shapes the electron beams 28R, 28G and 28B emitted from the electron gun 16 and projects beam spots on the phosphor layers of specified colors.

With the color cathode-ray tube so constituted, the three electron beams emitted from the electron gun 16 are deflected in the horizontal and vertical directions by the magnetic field generated from the deflection yoke 14, and horizontally and vertically scan the phosphor screen 12 through the shadow mask 18, thereby displaying a color image.

In the above color cathode-ray tube, a metal implosion-proof band 11 is wound on the outer surface of the skirt portion 2 of the panel 1 in order to maintain implosion-proof characteristics of the cathode-ray tube. The implosion-proof band 11 has a rectangular shape and is formed of a mild steel having a uniform width and thickness. The band 11 has a pair of long sides 11*a* almost parallel with the long axis X of the panel 1 and a pair of short sides 11*b* almost parallel with the short axis Y thereof. The long sides 11*a* are brought into contact with the outer surfaces of the long side-walls of the skirt portion 2, while the short sides 11*b* are brought into contact with the outer surfaces of the short side-walls thereof.

The implosion-proof band 11 described above is banded against the outer surface of the skirt portion 2 of the panel 1 by the shrink-fit method. Specifically, the implosion-proof band 11, whose inner circumference is slightly shorter than the outer circumference of the skirt portion 2, is expanded by preheating. The expanded band 11 is mounted on the outer surface of the skirt portion 2 and then cooled. The skirt portion 2 is therefore banded with the implosion-proof band 11. When the band 11 is banded on the skirt portion 2, frictional force is generated therebetween, so that the band 11 tighten the panel 1. Consequently, at room temperature, a high banding or tightening force of the band 11 is applied to the panel 1 and the implosion-proof strength of the color cathode-ray tube is secured.

A tensile stress generates in on the skirt portion 2 of the panel 1. In this embodiment, the tensile stress of the short side-walls of the skirt portion 2 is greater than that of the long side-walls thereof. In the implosion-proof band 11 in a banded state or a cooled state, the yield point of a middle portion of each of the short sides 11*b* is 340 N/m$^2$, while the yield point of a middle portion of each of the long sides 11*a* is 300 N/m$^2$. The former yield point is set larger than the latter one. Thus, the short sides 11*b* of the implosion-proof band 11 tighten the short side walls of the skirt portion 2 with a higher banding force than that of the long sides 11*a*.

According to the color cathode-ray tube having the above structure, the banding force against the long and short side-walls of the skirt portion 2 of the panel 1 can be optimized by causing the yield points of the middle portions of the long and short sides of the implosion-proof band 11 to differ from each other, and the implosion-proof performance can be secured sufficiently by absorbing a difference between tensile stresses generated on the periphery of the panel 1. Particularly, in the foregoing embodiment, the yield points of the middle portions of the long and short sides 11*a* and 11*b* of the implosion-proof band 11 are caused to differ in accordance with a difference in tensile stress between the long and short side-walls of the skirt portion 2, so that the banding force of the implosion-proof band 11 against the long and short side-walls of the skirt portion 2 can be optimized.

The inventors of the present invention conducted implosion-proof tests on color cathode-ray tubes as described above (lots Nos. 1 to 4, the total number of tests is 96). Cathode-ray tubes each having an implosion-proof band whose yield point was as uniform as 320 N/m$^2$ all over the band after the band was heated and cooled, were prepared as comparative examples, and the same implosion proof tests were carried out on the comparative examples (lots Nos. 1 to 5, the total number of tests is 109). In the tests, a plurality of hit positions were selected based on UL Ball 7J. The respective results are shown in Tables of FIGS. 4 and 5.

It is evident from the test results that the acceptance rate of cathode-ray tubes of the present embodiment is 93.8% while that of cathode-ray tubes of the comparative examples is 88.1%, and the implosion-proof performance of cathode-ray tubes of the present embodiment is higher and so is the safety thereof.

A method for manufacturing a color cathode-ray tube having the above-mentioned structure will now be described and, more specifically, a method for banding an implosion-proof band will now be described.

First an implosion-proof band 11 is formed of a band-like mild steel having a uniform width and thickness, such as galvarium and zinclite (both are trade names). Before the band 11 is banded against a panel skirt portion 2 of a vacuum envelope 10, its yield point is substantially uniform all over the band. For example, it is 230 N/m$^2$.

The panel skirt portion 2 is banded with the implosion-proof band 11 by the shrink-fit method. In this case, the band 11 is heated and expanded such that its inner circumference becomes greater than the outer circumference of the skirt portion 2. For the heating, one of direct-current heating, a gas burner, and high-frequency heating can be selected.

The middle portions of the short sides 11*b* of the implosion-proof band 11 are heated to temperature which is higher than that of the other portions of the band 11 such that the yield point of the middle portions of the short sides 11*b* is set higher than that of the other portions of the band 11. For example, the middle portions of the short sides 11*b* are heated to about 500° C. and the other portions are heated to about 400° C.

A relationship between shrink-fit temperatures (heating temperatures) and yield points will be described with reference to FIG. 6.

Figure 6:
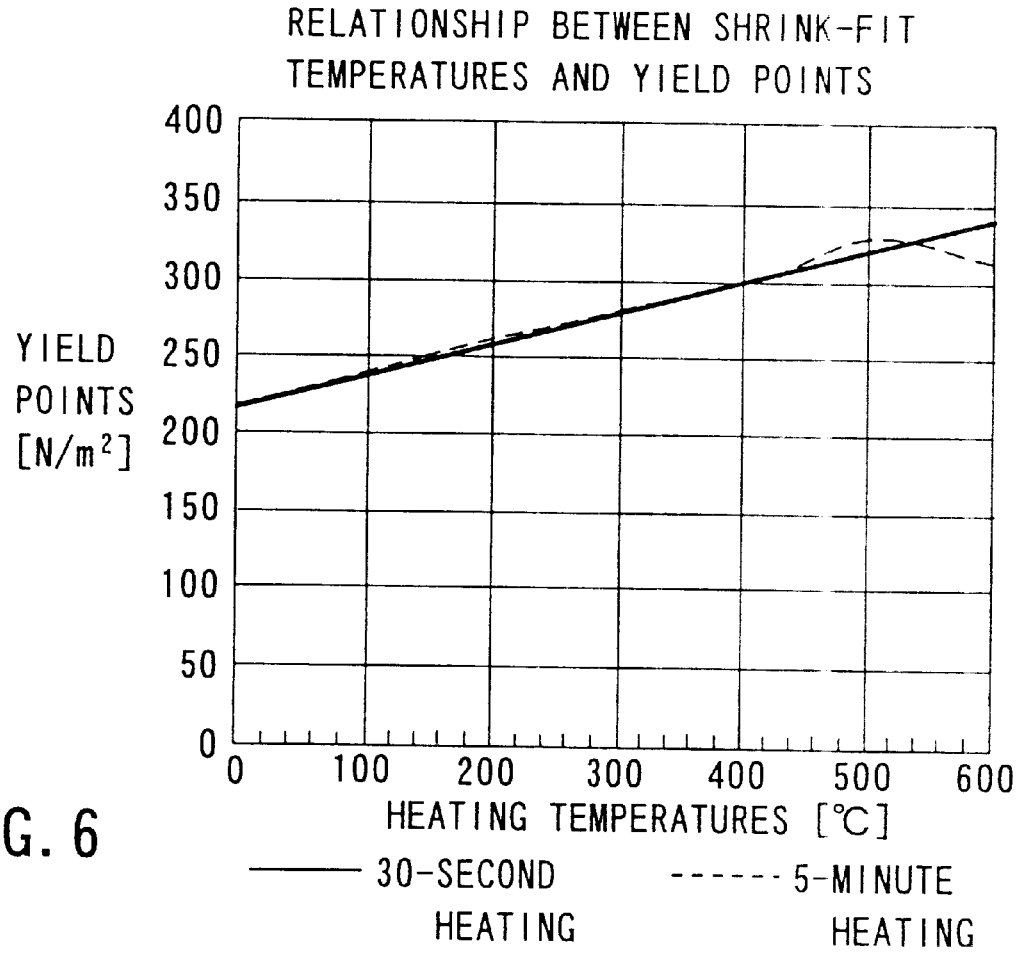
FIG. 6 is a graph showing a relationship between shrink-fit temperatures and yield points of an implosion-proof band of the cathode-ray tube according to the embodiment.

As illustrated in FIG. 6, the yield point of the implosion-proof band varies with both heating temperatures and heating time. In FIG. 6, the solid line indicates a relationship between the heating temperatures and yield points when the heating time is 30 seconds, while the dotted line shows a relationship between the heating temperatures and yield points when the heating time is 5 minutes. By setting the heating time and heating temperatures properly, the above-described implosion-proof band 11 having a yield point of 340 N/m$^2$ in the middle portion of each short side 11*b* and that of 300 N/m$^2$ in the middle portion of each long side 11*a*, can be obtained.

The implosion-proof band 11 expanded by heating is mounted on the outer surface of the skirt portion 2 of the panel 1 and then the whole implosion-proof band is cooled by a cooling fan or the like. Thus, the implosion-proof band 11 is decreased in temperature and shrunk and banded against the skirt portion 2.

As described above, by adjusting the heating temperatures and heating time of the respective portions of the implosion-proof band 11 when the band 11 is expanded by heating, the yield points of the middle portions-of the long and short sides of the band 11 can be caused to differ from each other. If, moreover, the yield points of the long and short sides are set in accordance with the tensile stresses in the long and short side-walls of the skirt portion 2, the banding force of the implosion-proof band 11 can be optimized, and a difference in tensile stress between the long and short side-walls of the skirt portion can be absorbed. Consequently, a safe color cathode-ray tube, which is excellent in implosion-proof characteristics, can be achieved.

Since, moreover, the banding force of the implosion-proof band is optimized by setting the yield point of a portion of the band to a desired value, the shape of the band need not be changed in particular. For example, the implosion-proof band need not be changed in width or provided with a bent portion. A plurality of implosion-proof bands can be formed using common implosion-proof band materials in such a manner that they can be fitted to various cathode-ray tubes and thus a waste of implosion-proof band materials can be eliminated. Furthermore, the implosion-proof band can be improved in versatility, thereby to reduce the manufacturing costs of the cathode-ray tube.

In the cathode-ray tube according to the foregoing embodiment, the tensile stress on the short side-walls of the skirt portion is greater than that on the long side-walls thereof. If, conversely, the tensile stress on the long side-walls is greater than that on the short side-walls, the implosion-proof band 11 is so formed that the yield point of the middle portions of the long sides 11*a* is 340 $N/m^2$ and that of the middle portions of the short sides 11*b* is 300 $N/m^2$ and, in this case, the other structure is the same as that of the above embodiment.

In such a cathode-ray tube, too, the banding force of the implosion-proof band can be optimized by causing the yield points of the long and short sides of the band to differ from each other in accordance with the tensile stress of the panel. Thus, a difference in tensile stress between the long and short side-walls of the skirt portion can be absorbed and the cathode-ray tube can be improved in implosion-proof characteristics.

The present invention is not limited to the above embodiment, but various changes and modifications can be made without departing from the scope of the subject matter of the present invention. For example, the materials of the implosion-proof band can be selected appropriately, and the yield points of the respective portions of the band can be set arbitrarily in accordance with the size and type of a cathode-ray tube. Moreover, the present invention is not limited to a color cathode-ray tube but can be applied to a monochrome cathode-ray tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising:

a vacuum envelope including a rectangular panel having a skirt portion;

a phosphor screen formed on an inner surface of the panel;

an electron gun provided in the vacuum envelope, for emitting an electron beam to the phosphor screen; and a substantially rectangular implosion-proof band having a pair of first side portions opposed to each other and a pair of second side portions crossing the first side portions and banded against an outer surface of the skirt portion, at least part of each of the first side portions of the implosion-proof band having a yield point which is different from that of another part of the implosion-proof band.

2. A cathode-ray tube according to claim 1, wherein a yield point of a middle portion of each of the first side portions in a longitudinal direction thereof is greater than that of a middle portion of each of the second side portions in a longitudinal direction thereof.

3. A cathode-ray tube according to claim 1, wherein a yield point of a middle portion of each of the second side portions in a longitudinal direction thereof is greater than that of a middle portion of each of the first side portions in a longitudinal direction thereof.

4. A cathode-ray tube according to claim 1, wherein the skirt portion of the panel includes a pair of first side-walls contacting the first side portions of the implosion-proof band and a pair of second side-walls contacting the second side portions thereof, the first side-walls and the second side-walls being applied with different tensile stresses; and the yield point of said at least part of the first side portions of the implosion-proof band and the yield point of said another part of the implosion-proof band differ from each other in accordance with a difference in tensile stress between the first and second side-walls of the skirt portion.

5. A cathode-ray tube according to claim 4, wherein the first side-walls of the skirt portion is applied with a tensile stress which is greater than the second side-walls; and a yield point of a middle portion of each of the first side portions of the implosion-proof band in a longitudinal direction thereof is greater than a yield point of a middle portion of each of the second side portions in a longitudinal direction thereof.

6. A cathode-ray tube according to claim 1, wherein the second side-walls of the skirt portion receive a tensile stress which is greater than the first side-walls; and a yield point of a middle portion of each of the second side portions of the implosion-proof band in a longitudinal direction thereof is greater than that of a middle portion of each of the first side portions in a longitudinal direction thereof.

7. A method for manufacturing a cathode-ray tube, comprising the steps of:

preparing a vacuum envelope including a panel with a skirt portion standing on an outer peripheral edge thereof;

preparing an implosion-proof band formed of metal and shaped in a rectangular frame, the implosion-proof band having a pair of first side portions opposed to each other and a pair of second side portions opposed to each other;

expanding the implosion-proof band by heating such that at least part of each of the first side portions and another part of the implosion-proof band are heated at different temperatures to cause yield points of said at least part and said another part to differ from each other; and mounting the implosion-proof band expanded by heating on an outer surface of the skirt portion, then cooling the implosion-proof band, and banding the outer surface of the skirt portion with the implosion-proof band.

8. A method according to claim 7, wherein the first side portions and the second side portions are heated at different temperatures such that a yield point of a middle portion of each of the first side portions and a yield point of a middle portion of each of the second side portions are caused to differ from each other in accordance with a difference in tensile stress between first side-walls of the skirt portion contacting the first side portions and second side-walls of the skirt portion contacting the second side portions.

9. A method according to claim 7, wherein the first side portions are heated at temperature which is higher than the second side portions in such a manner that a yield point of a middle portion of each of the first side portions is set higher than a yield point of a middle portion of each of the second side portions.

10. A method according to claim 7, wherein the second side portions are heated at temperature which is higher than the first side portions in such a manner that a yield point of a middle portion of each of the second side portions is set higher than a yield point of a middle portion of each of the first side portions.

* * * * *